US007287407B2

(12) United States Patent
Stout, Jr. et al.

(10) Patent No.: US 7,287,407 B2
(45) Date of Patent: Oct. 30, 2007

(54) DEVICE AND METHOD FOR FORMING A FLANGED RING

(75) Inventors: William K. Stout, Jr., Mason, OH (US); Ammon W. Weaver, Liberty, KY (US)

(73) Assignee: Eastern Sheet Metal, Cincinnati, OH (US)

( * ) Notice: Subject to any disclaimer, the term of this patent is extended or adjusted under 35 U.S.C. 154(b) by 177 days.

(21) Appl. No.: 11/126,753

(22) Filed: May 11, 2005

(65) Prior Publication Data

US 2005/0268686 A1 Dec. 8, 2005

Related U.S. Application Data

(60) Provisional application No. 60/571,294, filed on May 15, 2004.

(51) Int. Cl.
*B21D 11/08* (2006.01)

(52) U.S. Cl. ..... 72/167

(58) Field of Classification Search ..... 72/167, 72/166, 379.2

See application file for complete search history.

(56) References Cited

U.S. PATENT DOCUMENTS 2,047,084 A * 7/1936 Smith ..... 72/167
2,093,933 A * 9/1937 Sinclair ..... 72/171
2,826,804 A 3/1958 Wickwire et al.
3,749,425 A 7/1973 Howland
4,023,250 A 5/1977 Sproul et al.
4,041,746 A 8/1977 Kraft
4,117,704 A 10/1978 Nakache et al.
4,122,589 A * 10/1978 Grimm et al. ..... 29/898.067
4,144,732 A 3/1979 Franks et al.
4,170,888 A 10/1979 Golata
4,361,021 A 11/1982 McVay et al.
4,516,797 A 5/1985 Meinig
4,524,595 A 6/1985 Oda
4,765,167 A 8/1988 Sampson (Continued)

FOREIGN PATENT DOCUMENTS

EP 0296317 12/1988

(Continued)

*Primary Examiner*—Daniel C Crane
(74) *Attorney, Agent, or Firm*—Dinsmore & Shohl LLP

(57) ABSTRACT

A is adapted to form a flanged ring including an elongated curved extension from an elongated straight flange with an elongated base and an elongated protrusion extending from the elongated base. The device comprises a first pair of opposed surfaces adapted to compress an elongated protrusion of a flange to increase a length of the elongated protrusion. The device further includes a second pair of opposed surfaces adapted to compress an elongated base of a flange to increase the length of one portion of the elongated base relative to another portion of the elongated base. A flanged ring is also provided that is formed by process comprising the steps of providing a device including a first pair of opposed surfaces and a second pair of opposed surfaces. Still further a method of making a flanged ring includes the step of feeding the elongated straight flange with respect to the device such that a first pair of opposed surfaces compress an elongated protrusion to increase the length of the elongated protrusion and a second pair of opposed surfaces compress an elongated base to increase the length of one portion of the elongated base relative to another portion of the elongated base.

17 Claims, 12 Drawing Sheets

U.S. PATENT DOCUMENTS

| | | | |
|---|---|---|---|
| 5,253,501 | A | 10/1993 | Spath |
| 5,393,106 | A | 2/1995 | Schroeder |
| 5,456,099 | A | 10/1995 | Lipari |
| 5,983,496 | A | 11/1999 | Hermanson |
| 6,289,706 | B1 | 9/2001 | Hermanson |
| 6,301,781 | B1 | 10/2001 | Hermanson |
| 6,644,083 | B2 | 11/2003 | Pakker |
| 2003/0025332 | A1 | 2/2003 | Issagholian-Havai |

FOREIGN PATENT DOCUMENTS

| | | |
|---|---|---|
| GB | 624169 | 5/1949 |
| GB | 871733 | 6/1961 |
| GB | 1581386 | 12/1980 |
| JP | 59073125 | 4/1984 |
| JP | 60115331 | 10/1985 |

* cited by examiner

DEVICE AND METHOD FOR FORMING A FLANGED RING

CROSS-REFERENCE TO RELATED APPLICATION

This application claims priority under 35 U.S.C. §119 of U.S. application Ser. No. 60/571,294 filed May 15, 2004.

FIELD OF THE INVENTION

The present invention is directed to flanged rings and devices adapted to form flanged rings and methods. More particularly, flanged rings of the present invention are adapted for use as a connection element between ducts and duct couplings in air handling systems.

BACKGROUND OF THE INVENTION

Air handling systems used in HVAC applications to control air flow. Such handing systems typically include a network of duct components, such as duct elements and duct couplings that are fastened together to provide appropriate air flow to the desired locations. In order to provide an appropriate network, flanged rings are often used to facilitate connection between rectangular, circular and oval shaped duct elements and/or duct couplings. In particular, it is known to provide flanged circular or oval-shaped rings to connect corresponding circular and oval-shaped duct components. U.S. Pat. No. 5,983,496 to Hermanson discloses known circular and oval flanged rings. As set forth by Hermanson, flanged rings might include an elongated base and an elongated protrusion extended from the elongated base. In order to form such flanged rings, Hermanson discloses a method of spin forming the rings. While spin forming flanged rings might be desirable in certain situations, the process of spin forming can be time consuming and therefore might involve excessive manufacturing costs.

With an L-shaped flange profile, it is known to roll a flange to provide the desired flanged ring. For example, FIGS. 1-3 demonstrate a known process of forming a flanged ring from an L-shaped flange. The flanged ring is formed from an elongated straight flange with an elongated base 44 and an inner flange 42 forming an L-shaped flange profile. FIG. 1 illustrates a conventional device 20 for forming the L-shaped flanged ring. The device 20 includes an upper roller 22 and a lower roller 24. The rollers 22, 24 are adapted to provide a higher compressive force at an outer portion 44*a* of the elongated base 44 than an inner portion 44*b* of the elongated base. As the elongated straight flange is fed with respect to the device 20, the elongated base is compressed to increase the length of the outer portion 44*a* relative to the inner portion 44*b*, therefore forming an elongated curved extension 46.

With reference to FIG. 3, forming the flanged ring involves resting a substantially straight L-shaped flange on top of a support surface 26. A rotatable stop 30 can be adjusted along a slot to limit the extent of the curved bending of the elongated curved extension, thereby providing the curved extension with a predetermined radius of curvature. The flange is then fed with respect to the device 20 to form the elongated curved extension 46. A guide block guide block 28 is also provided to facilitate appropriate alignment of the flange with respect to the device.

The method of forming flanged rings with an L-shaped cross section described with respect to FIGS. 1-3 has the advantage of reducing production time and therefore reducing manufacturing costs. It is also desirable to provide further methods of forming flanged rings with various cross sectional profiles. For example, it is desirable to provide further methods of forming flanged rings from an elongated straight flange with an elongated base and an elongated protrusion. Forming flanged rings in such a manner might not be possible with the device depicted in FIGS. 1-3 if the protrusion has sufficient resistance to bending.

SUMMARY OF THE INVENTION

Accordingly, it is an object of the present invention to obviate problems and shortcomings of conventional devices for forming flanged rings and to provide flanged rings by an improved process.

In accordance with one aspect of the present invention, a device is provided that is adapted to form a flanged ring including an elongated curved extension from an elongated straight flange with an elongated base and an elongated protrusion extending from the elongated base. The device comprises a first pair of opposed surfaces adapted to compress an elongated protrusion of a flange to increase a length of the elongated protrusion. The device further includes a second pair of opposed surfaces adapted to compress an elongated base of a flange to increase the length of one portion of the elongated base relative to another portion of the elongated base.

In accordance with an additional aspect of the present invention, a flanged ring is provided with an elongated base and an elongated protrusion extending from the elongated base. The flanged ring is formed by the process comprising the steps of providing a device including a first pair of opposed surfaces and a second pair of opposed surfaces. The process further comprises the steps of providing an elongated straight flange with an elongated base and an elongated protrusion extending from the elongated base. Still further, the process further comprises the step of forming an elongated curved extension by feeding the elongated straight flange with respect to the device such that the first pair of opposed surfaces compress the elongated protrusion to increase the length of the elongated protrusion and the second pair of opposed surfaces compress the elongated base to increase the length of one portion of the elongated base relative to another portion of the elongated base.

In accordance with still further aspects and in accordance with the present invention, a method of making a flanged ring from a device including a first pair of opposed surfaces and a second pair of opposed surfaces is provided. The method includes the steps of providing an elongated straight flange with an elongated base and an elongated protrusion extending from the elongated base. The method further comprises the step of feeding the elongated straight flange with respect to the device such that the first pair of opposed surfaces compress the elongated protrusion to increase the length of the elongated protrusion and the second pair of opposed surfaces compress the elongated base to increase the length of one portion of the elongated base relative to another portion of the elongated base.

Still other objects and advantages of the present invention will become apparent to those skilled in the art from the following description wherein there are shown and described alternative exemplary embodiments of this invention. As will be realized, the invention is capable of other different, obvious aspects and embodiments, all without departing from the invention. Accordingly, the drawings and descriptions should be regarded as illustrative in nature and not as restrictive.

BRIEF DESCRIPTION OF THE DRAWINGS

The following detailed description will be more fully understood in view of the drawing in which.

Figure 1:
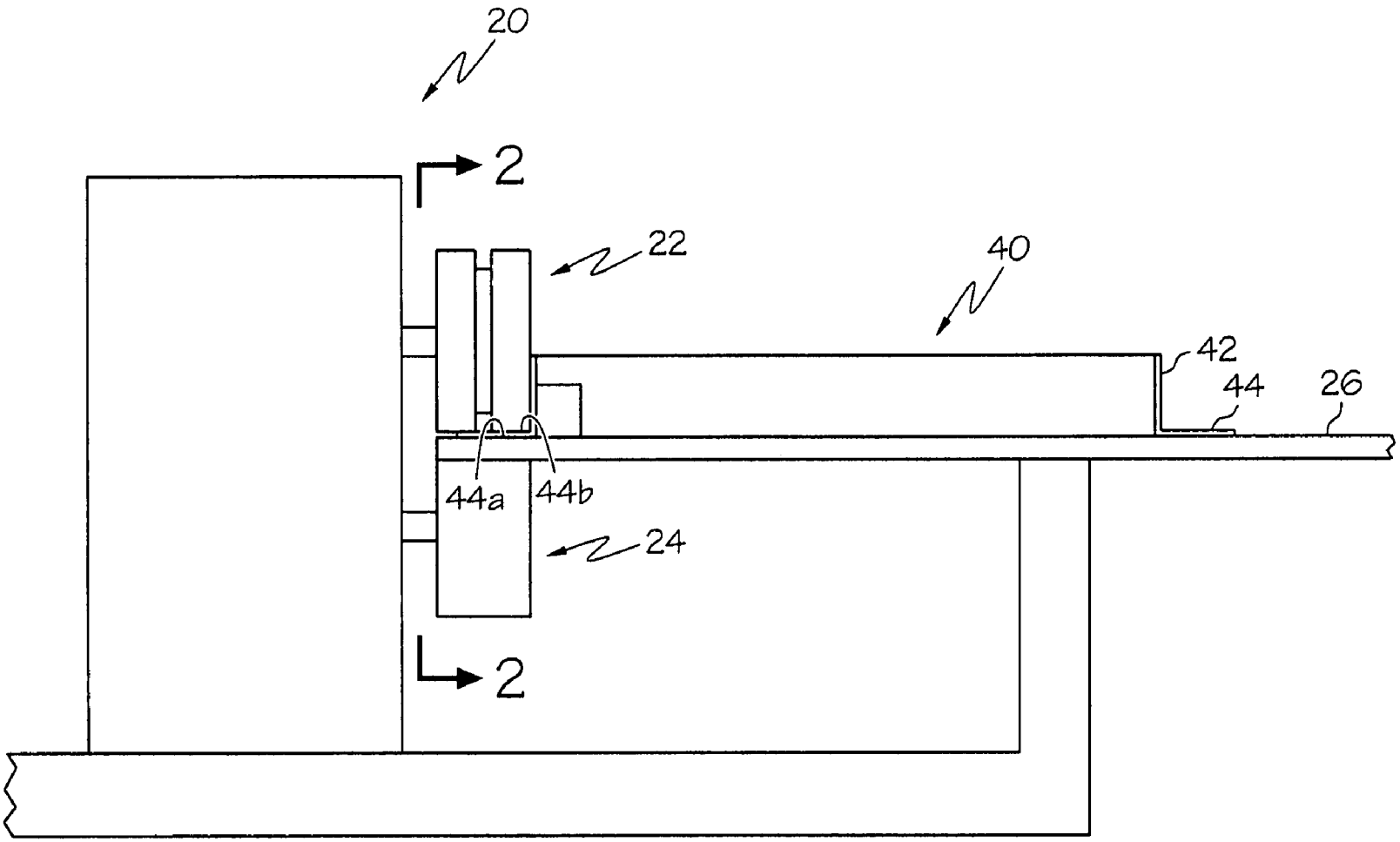
FIG. 1 (PRIOR ART)
FIG. 1 is a front elevational view of a conventional device for forming a flanged ring.
Figure 2:
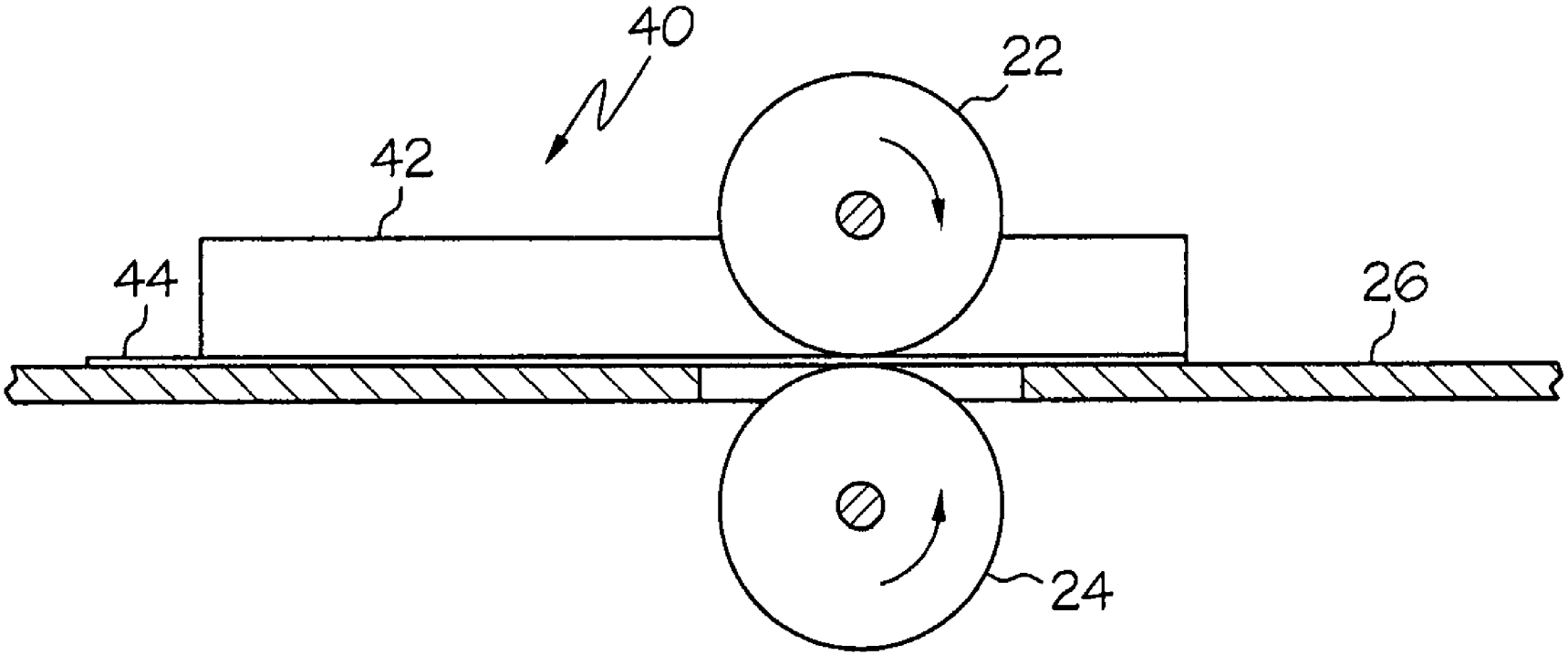
FIG. 2 (PRIOR ART)
FIG. 2 is a sectional view of the device of FIG. 1, along line 2-2 of FIG. 1.
Figure 3:
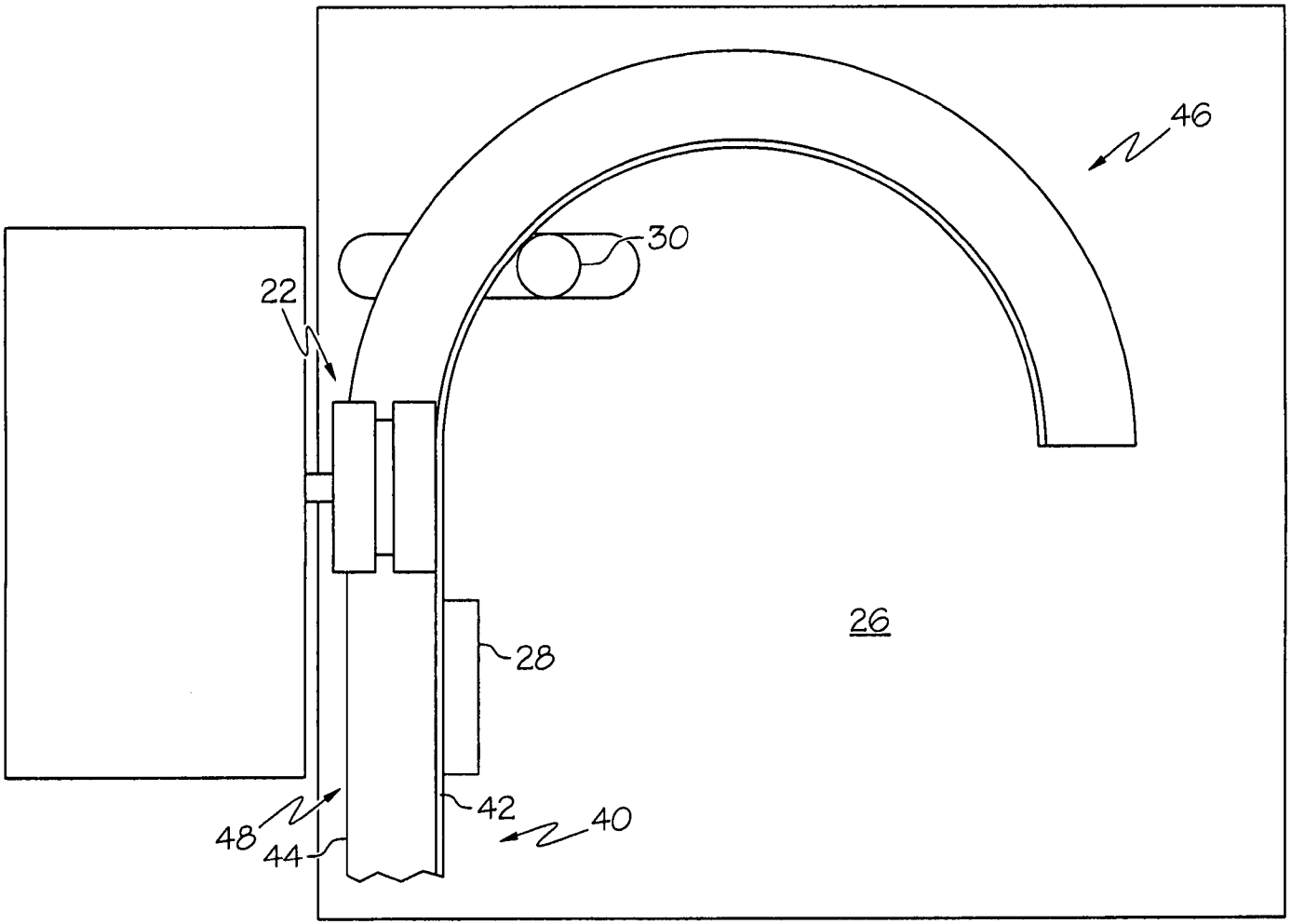
FIG. 3 (PRIOR ART)
FIG. 3 is a top plan view of the device of FIG. 1.

The embodiments set forth in the drawing are illustrative in nature and are not intended to be limiting of the invention defined by the claims. Moreover, individual features of the drawing and the invention will be more fully apparent and understood in view of the detailed description.

DETAILED DESCRIPTION

Figure 5:
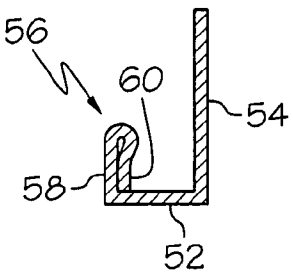
FIG. 5 (PRIOR ART)
FIG. 5 is a sectional view of the elongated straight flange along line 5-5 of FIG. 4.
Figure 4:
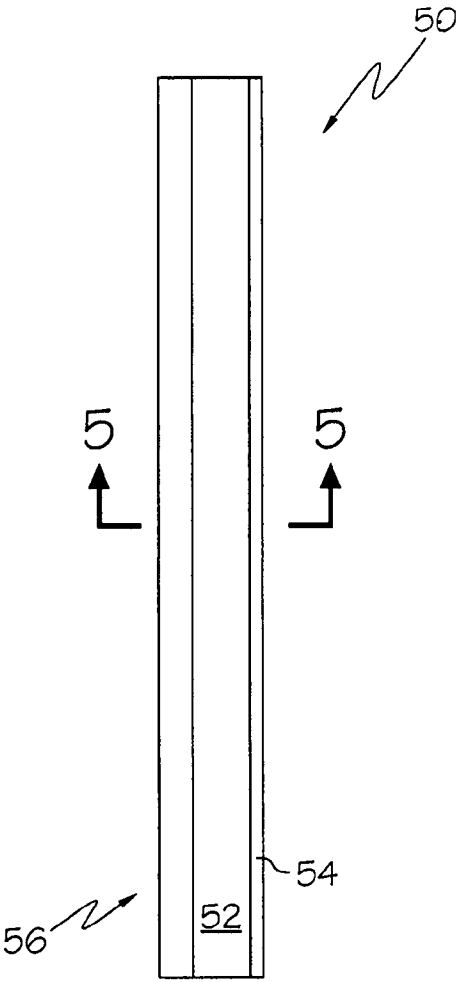
FIG. 4 (PRIOR ART)
FIG. 4 is a top plan view of a conventional elongated straight flange.

FIG. 4 depicts a conventional elongated straight flange 50 including an elongated inner flange 54 extending from an elongated base 52. As further shown, the elongated straight flange 50 includes an elongated protrusion 56 also extending from the base 52. The protrusion 56 might comprise a wide variety of shapes. For example, the protrusion 56 might comprise a single flange extending upward from the base. As shown in the cross section of FIG. 5, the elongated protrusion 56 might include an outer protrusion portion 58 and an inner protrusion portion 60 folded inward with respect to the outer protrusion. Although not shown, the inner protrusion might be attached to the base and the outer protrusion might be folded outward with respect to the inner protrusion. For example, an elongated straight flange might have a profile similar to the flanged ring illustrated in U.S. Pat. No. 5,983,496, such profile herein being incorporated by reference.

Figure 6:
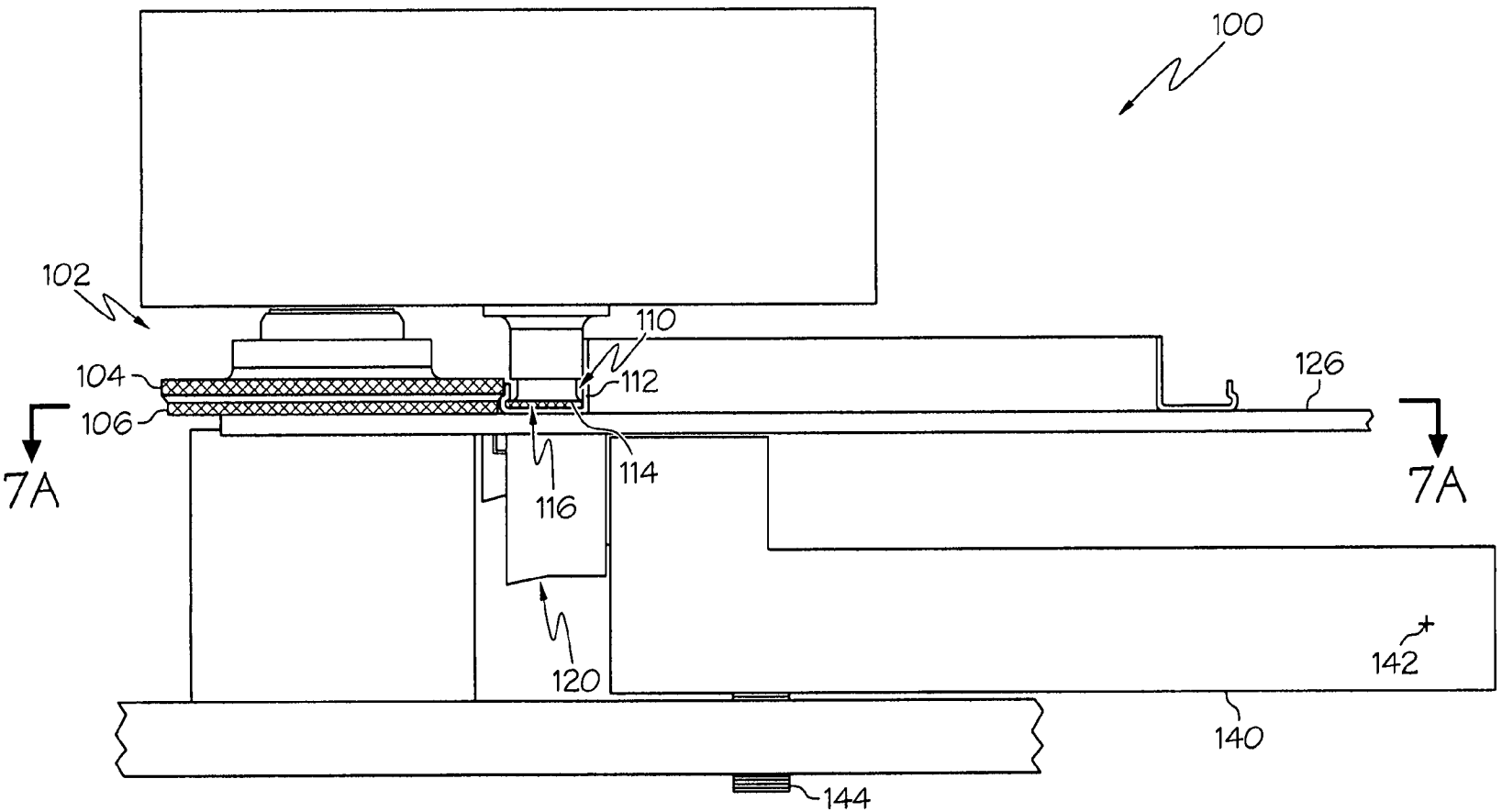
FIG. 6 is a front elevational view of a device for forming a flanged ring in accordance with one exemplary embodiment of the present invention.

FIG. 6 illustrates a device 100 for forming a flanged ring. The device 100 includes a first pair of opposed surfaces adapted to compress the elongated protrusion 56. For example, as shown, the device 100 might include a first wheel 102 rotatable about a first rotation axis 102*a* and a second wheel 110 rotatable about a second rotation axis 110*a* that is parallel to the first rotational axis. In such an embodiment the first pair of opposed surfaces comprises an outer peripheral surface of the first wheel 102 and an outer peripheral surface of the second wheel 110. In one particular embodiment, the first wheel includes a first peripheral surface 104 including a first diameter and a second peripheral surface 106 including a second diameter that is less than the first diameter. In such an embodiment, the peripheral surface of the second wheel 110 might also include a first peripheral surface 112 including a first diameter and a second peripheral surfaces 114 including a second diameter that is greater than the first diameter of the first peripheral surface. Therefore, the first and second peripheral surface portions 104, 106 of the first wheel 102 are adapted to cooperate with the corresponding first and second surface portions 112, 114 of the second wheel 110 to form an offset in the elongated protrusion. Forming such an offset in the elongated protrusion facilitates shaping of the elongated protrusion as it is formed as part of the curved extension.

In particular embodiments, portions of the peripheral surface of the first wheel 102 and/or the peripheral surface of the second wheel 110 might be knurled to facilitate gripping and elongation of the elongated protrusion as it is fed with respect to the device 100. For example, as shown, the first peripheral surface 104 and the second peripheral surface 106 of the first wheel 102 might be knurled and the second peripheral surface 114 of the second wheel 110 might be knurled.

Figure 7A:
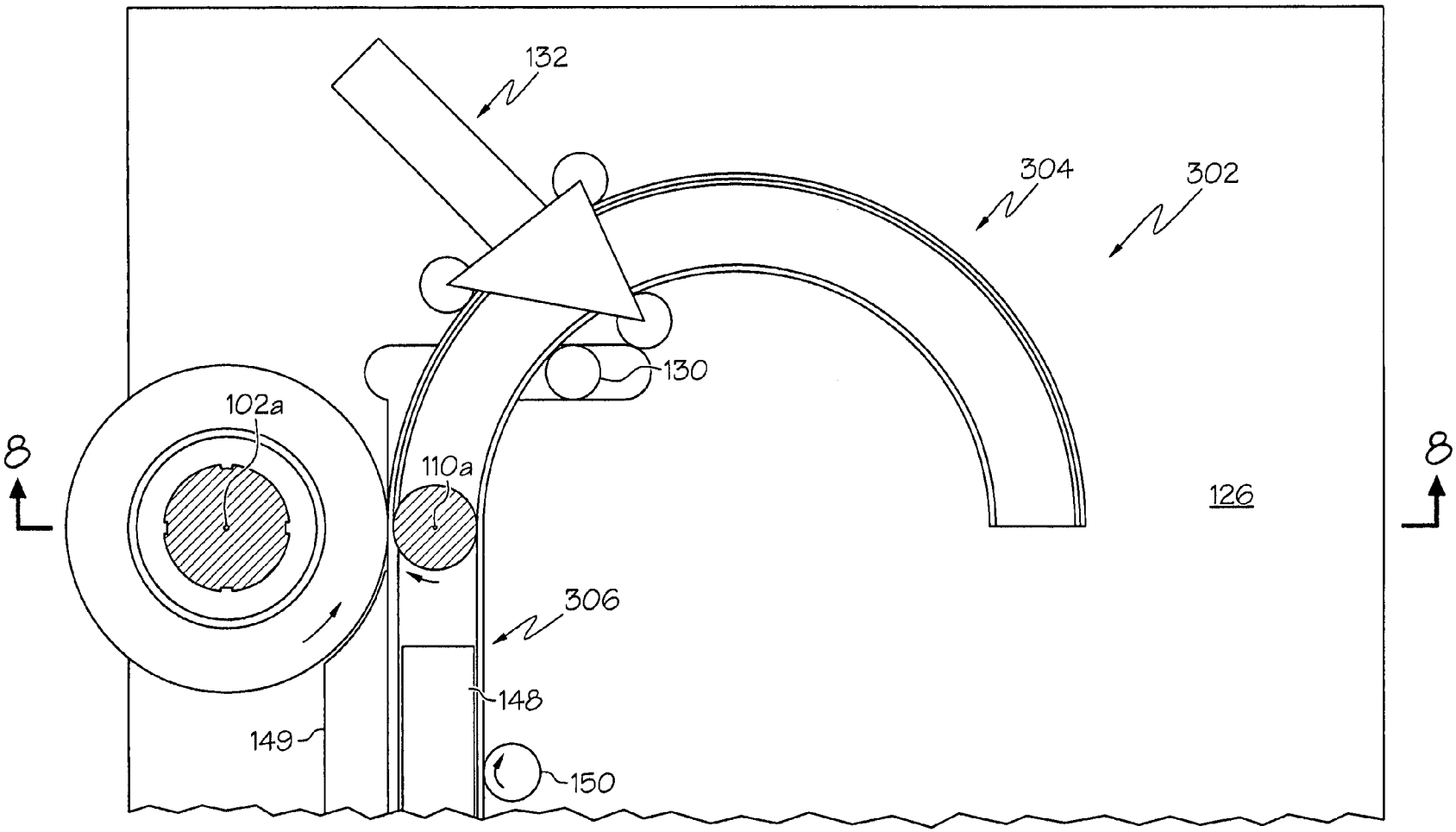
FIG. 7A is a sectional view of the device along line 7A-7A of FIG. 6.
Figure 7B:
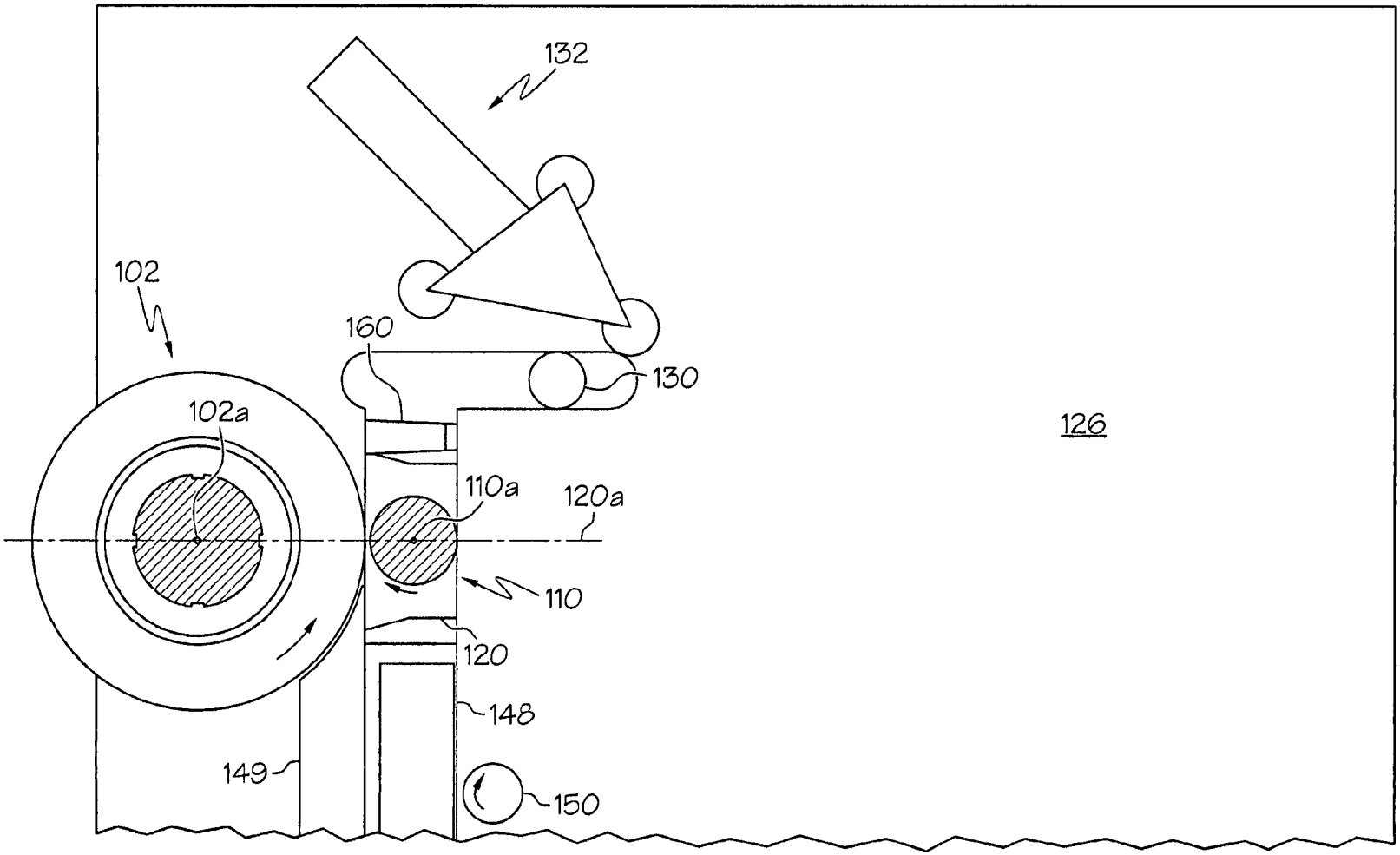
FIG. 7B is a sectional view of the device along line 7A-7A wherein the J-shaped flange portion has been removed for clarity.
Figure 8:
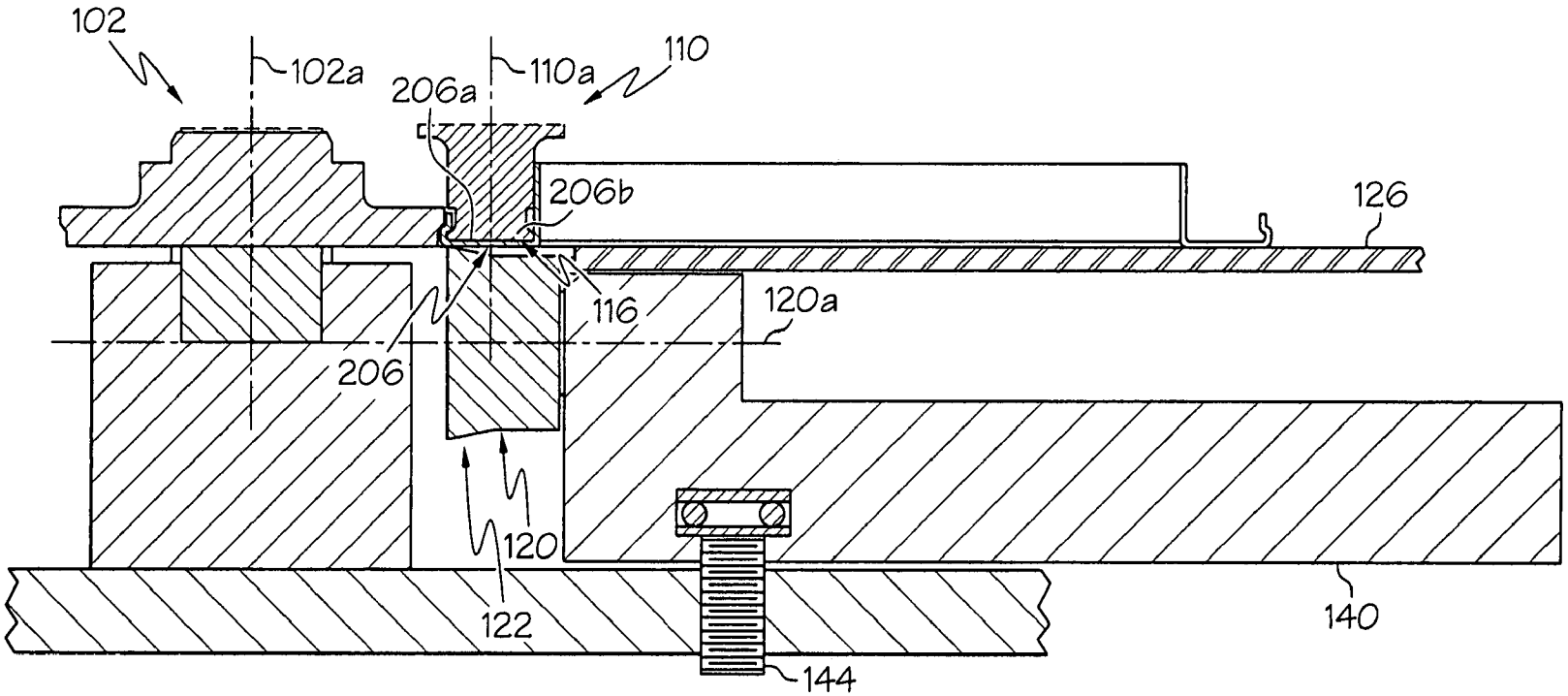
FIG. 8 is a sectional view of the device along line 8-8 of FIG. 7A.

The device 100 further includes a second pair of opposed surfaces adapted to compress the elongated base 52 of the flange 50 to increase the length of one portion of the elongated base relative to another portion of the elongated base. As shown in FIGS. 7B and 8, the device 100 can include a roller 120 including an outer peripheral surface, wherein one of the second pair of opposed surfaces comprises the outer peripheral surface 122 of the roller 120. Shown exaggerated in the figures for clarity, outer peripheral surface 122 the roller 120 might comprise a conical portion to provide increase compression force at an outer portion 206*a* than an inner portion 206*b* of the elongated base 206. Therefore, the difference in compression force facilitates an increase in length of the outer portion 206*a* of the elongated base 206 relative to the inner portion 206*b* of the base 206 to form an elongated curved extension from the elongated straight flange as the elongated straight flange is fed with respect to the device 100.

As further illustrated in FIG. 8, the second wheel 110 can include a bearing surface 116 that acts together with the outer peripheral surface 122 of the roller 120 to provide the second pair of opposed surfaces adapted to compress the elongated base 206. As shown, the bearing surface 116 comprises a substantially flat surface that is perpendicular to the rotational axis 110*a* of the second wheel 110. As shown in FIGS. 7B and 8, the rotational axis 120*a* of the roller 120 can also be perpendicular to the rotational axes 102*a*, 110*a* of the first and second wheel 102, 110.

The exemplary roller 120 illustrated and described herein might be mounted for relative movement with respect to the support surface 126. As shown, the roller 120 is rotatably mounted on a lever arm 140. The lever arm 140 has a pivot axis 142 (see FIG. 6) and a jack screw 144 adapted to provide the appropriate angular adjustment between the lever arm 140 and the support surface 126.

It is contemplated that a wide range of structures might be provided in order to compress the outer portion 206*a* of the base 206 to a larger extent than the inner portion 206*b* of the base 206. As shown, the conical shape of the outer peripheral surface 122 of the roller 120 might provide the appropriate structure. In further examples, the rotational axis of the roller 120 might be adjustable to provide a desirable distribution of compressive forces.

A method of making a flanged ring with the device 100 includes first providing an elongated straight flange with an elongated base and an elongated protrusion extending from the elongated base. Although not necessary, the elongated straight flange might further comprise an elongated inner flange. For example, the elongated straight flange 50 illustrated in FIGS. 4 and 5 might be provided. Next, the elongated straight flange is fed with respect to the device 100 such that the first pair of opposed surfaces compress the elongated protrusion 56 to increase the length of the elongated protrusion and the second pair of opposed surfaces compress the elongated base 52 to increase the length of the outer portion of the base relative to the inner portion of the elongated base.

In particular embodiments, a rotatable stop 130 might also be provided and initially adjusted prior to feeding the elongated straight flange with respect to the device to provide a predetermined radius to the elongated curved extension. An optional secondary guide 132 might also be provided to fine-tune the radius of the curved extension. As shown, the secondary guide 132 might include a set of three guide wheels rotatably mounted with respect to a lever arm. A squaring roll 160 might also be included to discourage helical twisting of the flange as it is fed through the first and second pair of opposed surfaces. The device 100 might also include an infeed guide roller 150 and guide blocks 148, 149. The guide roller 150 may be an idler roller or might also be driven to provide a controlled the feed rate of the elongated straight flange with respect to the device.

Figure 12:
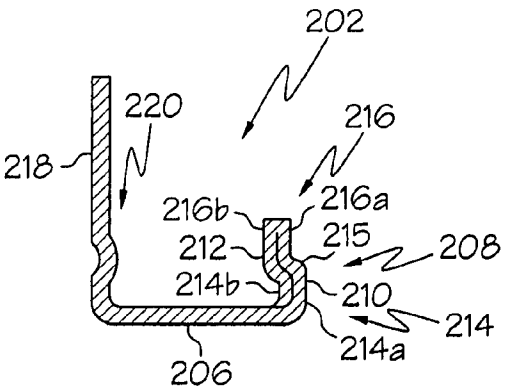
FIG. 12 is a sectional view of the flanged ring along section 12-12 of FIG. 9.

An exemplary circular flanged ring 200 formed with the device 100 is illustrated in FIGS. 9-12. To form the circular flanged ring 200, an elongated straight flange is fed with respect to the device 100 until the elongated curved extension follows an arc of at least about 360°. The ends of the curved extension may then be welded at a weld seam 204 to form the circular ring. As shown in FIG. 12, the profile of the circular flanged ring 200 includes an elongated inner flange 218 extending from an elongated base 206 and an elongated protrusion 208 also extending from the elongated base 206. The elongated inner flange 218 might include an optional bead 220 that is conventionally provided with such profiles. In alternative embodiments, the optional bead 220 might not be provided.

As further illustrated in FIG. 12, the elongated protrusion 208 includes an outer protrusion portion 210 and an inner protrusion portion 212 that, as described above, might optionally be folded inward with respect to the outer protrusion portion 210 as shown. The elongated protrusion 208 might also include a first portion 214 and a second portion 216 offset from the first portion 214 with a transition 215 section attaching the first portion 214 to the second portion 216 to permit the first and second portion to be concentric with respect to one another.

Figure 9:
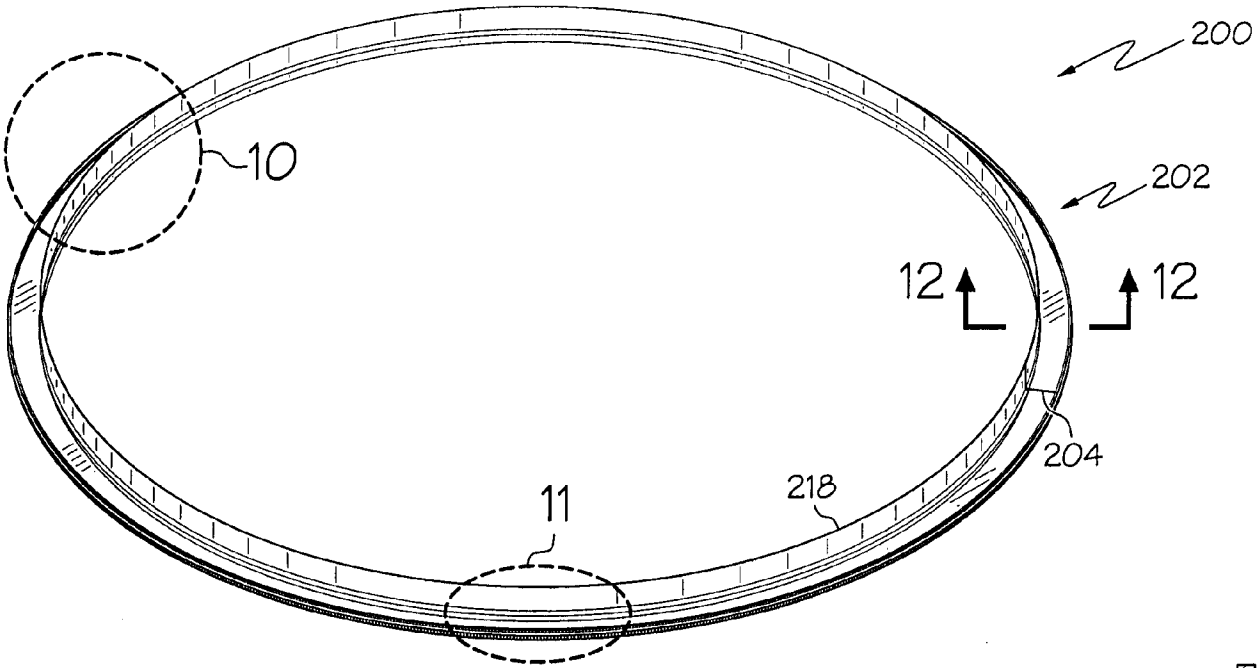
FIG. 9 is a perspective view of a flanged ring having a circular shape formed by the device of FIG. 6.
Figure 10:
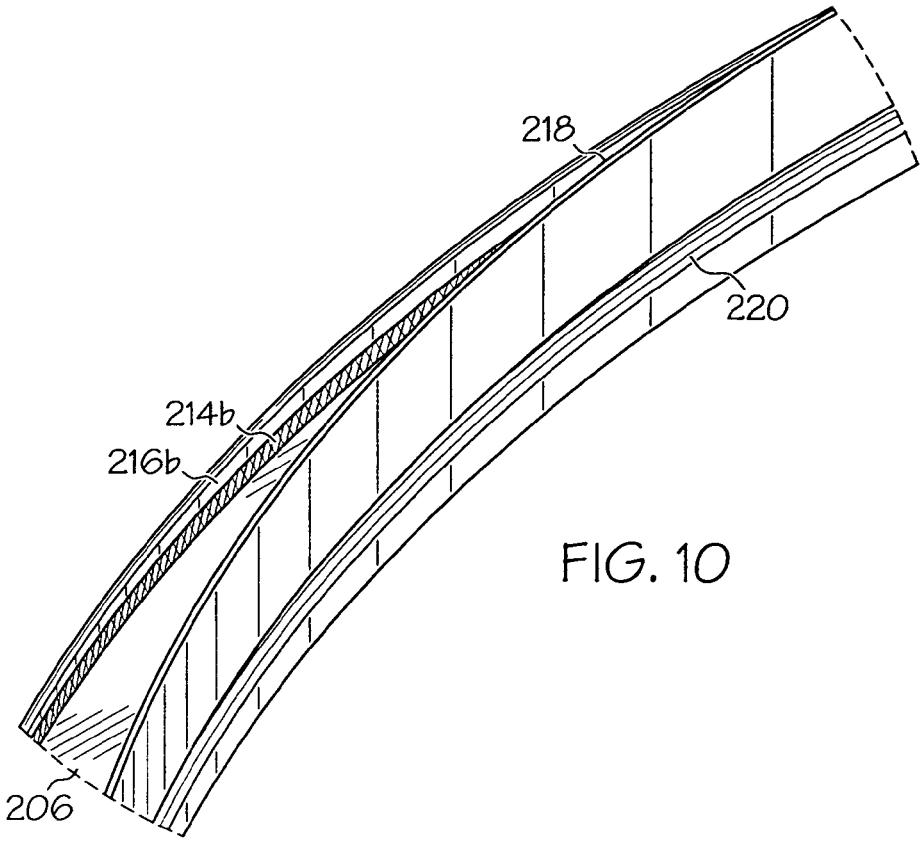
FIG. 10 is an enlarged view of a portion of the flanged ring at view 10 of FIG. 9.
Figure 11:
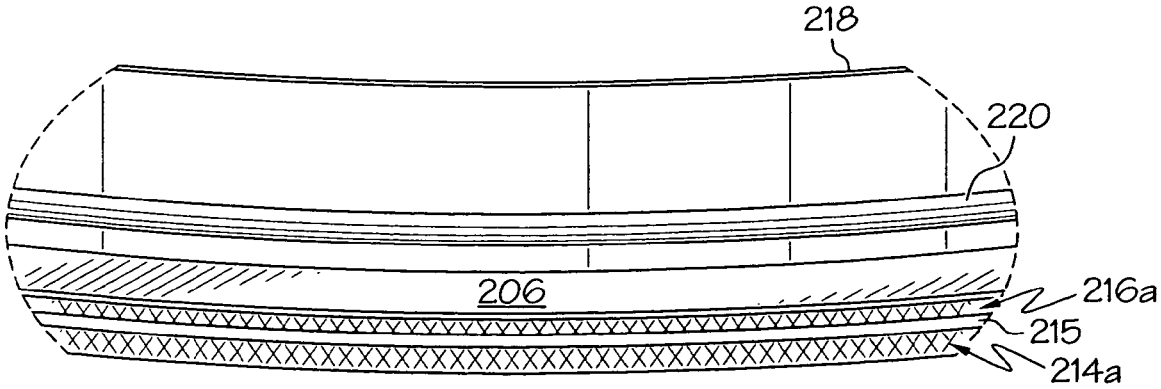
FIG. 11 is an enlarged view of a portion of the flanged ring at view 11 of FIG. 9.

In the exemplary embodiment shown, the first portion 214 includes an outer surface portion 214*a* and the second portion 216 includes an outer surface portion 216*a*, wherein the outer surface portions 214*a* and 216*a* might be knurled as illustrated in FIGS. 9 and 11. As best illustrated in FIGS. 9 and 10, the inner surface portion 214*b* of the first portion 214 might also include a knurled surfaces.

Figure 13:
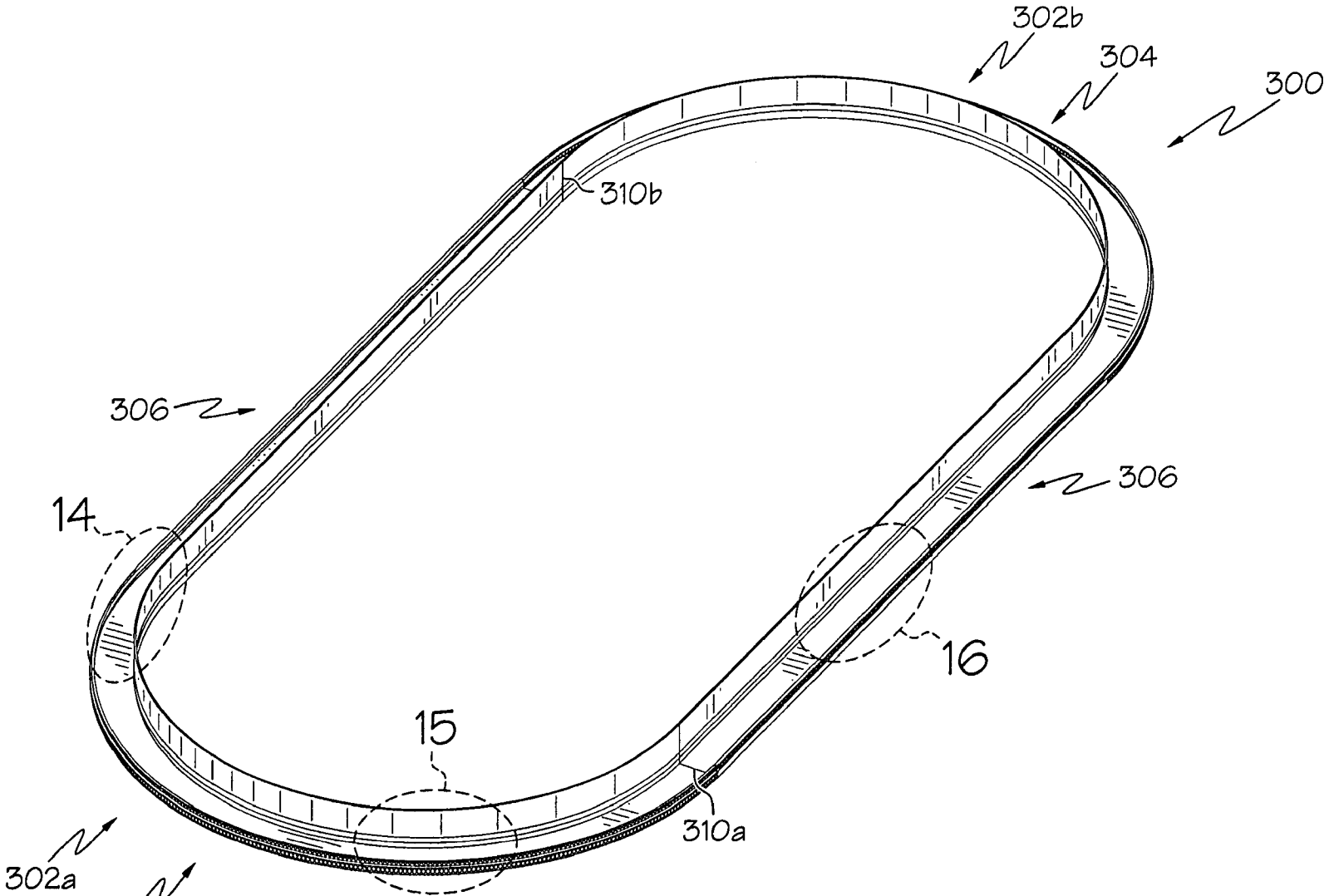
FIG. 13 is a perspective view of an oval-shaped flanged ring formed by the device of FIG. 6.
Figure 15:
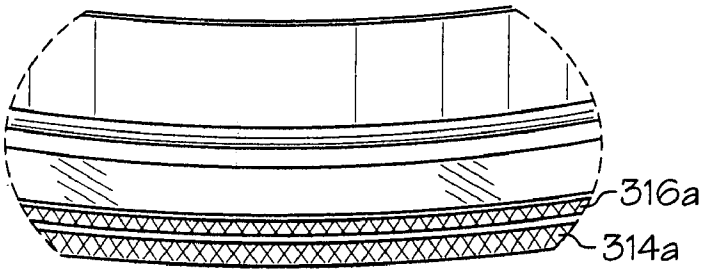
FIG. 15 is an enlarged view of a portion of the flanged ring at view 15 of FIG. 13.
Figure 16:
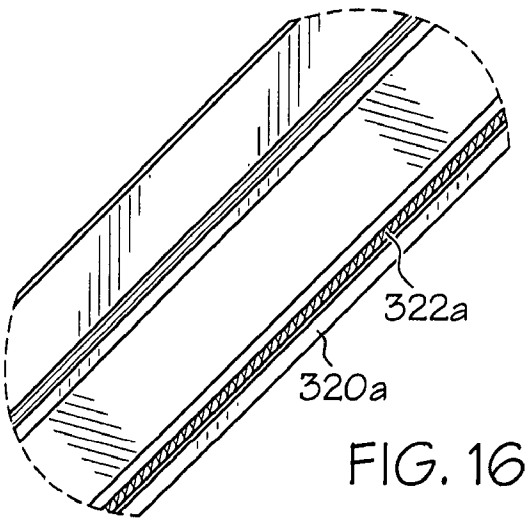
FIG. 16 is an enlarged view of a portion of the flanged ring at view 16 of FIG. 13.
Figure 14:
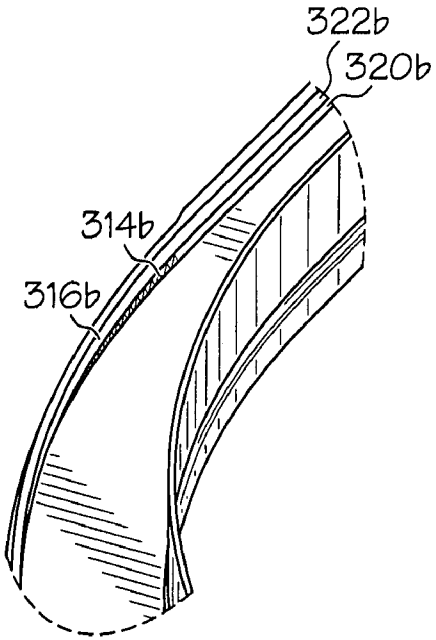
FIG. 14 is an enlarged view of a portion of the flanged ring at view 14 of FIG. 13.

An exemplary oval flanged ring 300 formed with the device 100 is illustrated in FIGS. 13-16. To form the oval flanged ring 300, an elongated straight flange is fed with respect to the device 100 until the elongated curved extension follows an arc of at least about 180°. For example, the elongated straight flange might be fed with respect to the device 100 until a substantial J-shaped flange portion 302 is formed as shown in FIG. 7A. The J-shaped portion 302 includes an elongated curved extension 304 and an elongated straight extension 306. Two such J-shaped portions might be fastened with respect to one another to form an exemplary oval-shaped flanged ring. For example, as shown in FIG. 13, a first J-shaped flanged portion 302*a* is inverted with respect to a second J-shaped flanged portion 302*b* and welded at weld seams 310*a*, 310*b* to form the oval shaped flanged ring. The elongated curved extension 304 might include knurled surfaces. For example, an outer surface 314*a* of the first portion and an outer surface 316*a* of the second portion might have a knurled surface as shown in FIG. 15. In addition, the inner surface 314*b* of the first portion might be knurled while the inner surface 316*b* of the second portion might not include a knurled surface. Moreover, an outer surface 322*a* of the second portion of the elongated straight extension 306 might be knurled while the outer surface 320*a* and inner surface 320*b* of the first portion and the inner surface 322*b* of the second portion might not include knurled surfaces. The outer surface 322*a* might be knurled during the process of continuing to feed the J-shaped flange portion 302 with respect to the device 100 after sufficient compression has been removed to prevent further curving of the extension as it is being fed.

As shown in the drawings, oval-shaped includes a shape with end portions extending through 180° with straight segments attaching the end portions together. Although not shown, oval-shaped flanged rings might include rings that have an elliptical shape or egg shape.

Throughout this application knurled surfaces might include any textured surface wherein one surface forms or cuts, such as stamps, an imprint on another surface.

The specific illustrations and embodiments described herein are exemplary only in nature and are not intended to be limiting of the invention defined by the claims. Further embodiments and examples will be apparent to one of ordinary skill in the art in view of this specification and are within the scope of the claimed invention.

What is claimed is:

1. A device adapted to form a flanged ring including an elongated curved extension from an elongated straight flange with an elongated base and an elongated protrusion extending from the elongated base, the device comprising:

a) a first wheel rotatable about a first rotational axis and a second wheel rotatable about a second rotational axis that is parallel to the first rotational axis, wherein corresponding outer peripheral surfaces of the first wheel and the second wheel form a first pair of opposed surfaces adapted to compress the elongated protrusion to increase a length of the elongated protrusion, the outer peripheral surface of the first wheel including a first peripheral surface portion having a first diameter and a second peripheral surface portion having a second diameter that is less than the first diameter, and the outer peripheral surface of the second wheel including a first peripheral surface portion having a first diameter and a second peripheral surface portion having a second diameter that is greater than the first diameter of the first peripheral surface of the second wheel, wherein the first and second peripheral surface portions of the first wheel are adapted to cooperate with the corresponding first and second surface portions of the second wheel to form an offset in the elongated protrusion; and b) a second pair of opposed surfaces adapted to compress an elongated base of the flange to increase the length of one portion of the elongated base relative to another portion of the elongated base.

2. The device of claim 1, wherein the outer peripheral surfaces of the first and second wheel include knurled surfaces.

3. The device of claim 1, wherein the first and second peripheral surface portions include knurled surfaces.

4. The device of claim 1, wherein the first and second peripheral surface portions of the first wheel are knurled while only the second peripheral surface portion of the second wheel is knurled.

5. The device of claim 1, further comprising a roller including an outer peripheral surface, wherein one of the second pair of opposed surfaces comprises the outer peripheral surface of the roller.

6. The device of claim 5, wherein the roller includes a conical portion.

7. The device of claim 5, wherein the roller is rotatable about a third rotational axis that is perpendicular to the first and second rotational axes.

8. The device of claim 5, wherein the other of the second pair of opposed surfaces comprises a bearing surface of the second wheel.

9. The device of claim 8, wherein the bearing surface is perpendicular to the second rotation axis.

10. A method of making a flanged ring from a device including a first pair of opposed surfaces and a second pair of opposed surfaces, comprising the steps of:

a) providing an elongated straight flange with an elongated base and an elongated protrusion extending from the elongated base;

b) feeding the elongated straight flange with respect to the device such that the first pair of opposed surfaces compress the elongated protrusion to increase the length of the elongated protrusion, wherein the device further forms a first portion in the elongated protrusion and a second portion offset from the first portion in the elongated protrusion, and the second pair of opposed surfaces compress the elongated base to increase the length of one portion of the elongated base relative to another portion of the elongated base.

11. The method of claim 10, wherein the step of feeding the elongated straight flange with respect to the device forms an elongated curved extension.

12. The method of claim 11, wherein the elongated curved extension forms a substantially circular ring.

13. The method of claim 11, wherein the elongated curved extension at least partially forms a substantially oval-shaped ring.

14. The method of claim 10, wherein the step of feeding the elongated straight flange with respect to the device further comprises knurling the elongated protrusion to form a knurled outer peripheral surface.

15. The method of claim 10, wherein the step of feeding the elongated straight flange with respect to the device further comprises knurling the elongated protrusion to form a knurled inner peripheral surface.

16. A device adapted to form a flanged ring including an elongated curved extension from an elongated straight flange with an elongated base and an elongated protrusion extending from the elongated base, the device comprising:

a) a first wheel rotatable about a first rotational axis and a second wheel rotatable about a second rotational axis that is parallel to the first rotational axis, wherein corresponding outer peripheral surfaces of the first wheel and the second wheel form a first pair of opposed surfaces adapted to compress the elongated protrusion to increase a length of the elongated protrusion, the outer peripheral surfaces of the first and second wheel including knurled surfaces; and b) a second pair of opposed surfaces adapted to compress an elongated base of the flange to increase the length of one portion of the elongated base relative to another portion of the elongated base.

17. A device adapted to form a flanged ring including an elongated curved extension from an elongated straight flange with an elongated base and an elongated protrusion extending from the elongated base, the device comprising:

a) a first wheel rotatable about a first rotational axis and a second wheel rotatable about a second rotational axis that is parallel to the first rotational axis, wherein corresponding outer peripheral surfaces of the first wheel and the second wheel form a first pair of opposed surfaces adapted to compress the elongated protrusion to increase a length of the elongated protrusion, the outer peripheral surface of the first wheel including a first peripheral surface portion having a first diameter and a second peripheral surface portion having a second diameter that is less than the first diameter, the first and second peripheral surface portions including knurled surfaces; and b) a second pair of opposed surfaces adapted to compress an elongated base of the flange to increase the length of one portion of the elongated base relative to another portion of the elongated base.

* * * * *